US007976445B2

(12) United States Patent
Lalaoua

(10) Patent No.: US 7,976,445 B2
(45) Date of Patent: Jul. 12, 2011

(54) DOOR MOUNTED GYM

(76) Inventor: Nabile Lalaoua, Solvang, CA (US)

( * ) Notice: Subject to any disclaimer, the term of this patent is extended or adjusted under 35 U.S.C. 154(b) by 0 days.

(21) Appl. No.: 12/470,290

(22) Filed: May 21, 2009

(65) Prior Publication Data

US 2010/0173759 A1 Jul. 8, 2010

(51) Int. Cl.
*A63B 21/04* (2006.01)
*A63B 21/02* (2006.01)

(52) U.S. Cl. ..... 482/129; 482/121; 482/904

(58) Field of Classification Search ..... 482/121–123, 482/129, 904
See application file for complete search history.

(56) References Cited

U.S. PATENT DOCUMENTS

| | | | | |
|---|---|---|---|---|
| 2,959,414 | A | | 11/1960 | Saltz |
| 4,830,365 | A | * | 5/1989 | March ..... 482/129 |
| 4,896,881 | A | | 1/1990 | Djerdjerian |
| 5,029,580 | A | | 7/1991 | van Straaten |
| 5,040,788 | A | | 8/1991 | Randall |
| 5,050,569 | A | | 9/1991 | Beunk et al. |
| 5,468,205 | A | * | 11/1995 | McFall et al. ..... 482/129 |
| 5,601,518 | A | | 2/1997 | Weintraub |
| 5,820,529 | A | * | 10/1998 | Weintraub ..... 482/92 |
| 5,871,424 | A | * | 2/1999 | Conner ..... 482/129 |
| 5,910,073 | A | * | 6/1999 | Conner ..... 482/129 |
| 6,015,371 | A | * | 1/2000 | Davitt ..... 482/129 |
| 6,059,698 | A | * | 5/2000 | Mazor ..... 482/79 |
| 6,067,472 | A | | 5/2000 | Vonk et al. |
| 6,267,711 | B1 | | 7/2001 | Hinds |
| 6,494,817 | B2 | | 12/2002 | Lake |
| 6,612,972 | B1 | | 9/2003 | Reichard |
| 6,652,419 | B1 | | 11/2003 | Rota |
| 6,662,651 | B1 | | 12/2003 | Roth |
| 6,908,418 | B2 | | 6/2005 | Saure |
| 2002/0119869 | A1 | | 8/2002 | Whited Lake |
| 2003/0054926 | A1 | | 3/2003 | Toole |
| 2005/0227827 | A1 | | 10/2005 | Liester |
| 2006/0084556 | A1 | | 4/2006 | Payne |
| 2008/0119763 | A1 | | 5/2008 | Wiener |

OTHER PUBLICATIONS

PCT Search Report dated Jun. 28, 2010 for Internation App. No. PCT/US2010/028369.

* cited by examiner

*Primary Examiner* — Fenn C Mathew
(74) *Attorney, Agent, or Firm* — Blakely, Sokoloff, Taylor & Zafman

(57) ABSTRACT

A portable door mounted exercise system that can be easily set up and taken down and which doesn't occupy any significant floor space. The system provides variable resistance for aerobic, cardiovascular and muscle building exercises. Variable resistance is provided through a set of elastic cords. A user can select to use any combination of the cords to provide a desired level of resistance for exercise and training. The cords can be attached to a handle, ankle strap, squat strap or neck strap depending on the type of exercise or training desired by the user. The cords can be attached to a pulley system and bracket which is slidably attached to a door mount to provide variable positioning for the pulley system. The system can also include a training computer to provide audio and video training information to the user.

9 Claims, 7 Drawing Sheets

DOOR MOUNTED GYM

BACKGROUND

1. Field of the Invention

The embodiments of the invention relate to personal fitness machines. Specifically, the embodiments of the invention relate to a door mounted exercise apparatus.

2. Background of the Invention

The awareness of the importance of cardiovascular and muscle training has increased the demand for affordable and convenient home exercise equipment. While gyms and health clubs typically offer a variety of sophisticated and expensive equipment, they have limited or distant locations, limited hours, long term contracts and high membership fees. Even when these limitations are not an impediment, travel, changes in schedules, holidays and work can prevent the use of these facilities.

Many types of exercise machines have been produced and marketed to individual consumers. These exercise machines include stationary bikes, elliptical machines, treadmills, weight machines and similar apparatuses. While designed and marketed for the home, these machines are still relatively costly. These devices are also heavy, cumbersome and large. As a result, these devices are not suitable for use during travel as they are not easily portable. The devices also take up considerable floor space. As a result, there are a limited number of locations in the home where there is sufficient space for the exercise machines. Many of these locations are not suitable because they would interrupt the other uses of a room. For example, the exercise machines are usually quite loud, when in use. As a result, they are inconvenient to use in areas where other individuals might be disturbed, such as other family members who are sleeping, watching television or engaged in similar activities. As a result, these home exercise machines are impractical for many individuals.

BRIEF DESCRIPTION OF THE DRAWINGS

The present invention is illustrated by way of example, and not by way of limitation, in the figures of the accompanying drawings in which like references indicate similar elements. It should be noted that different references to "an" or "one" embodiment in this disclosure are not necessarily to the same embodiment, and such references mean at least one.

DETAILED DESCRIPTION

Figure 1:
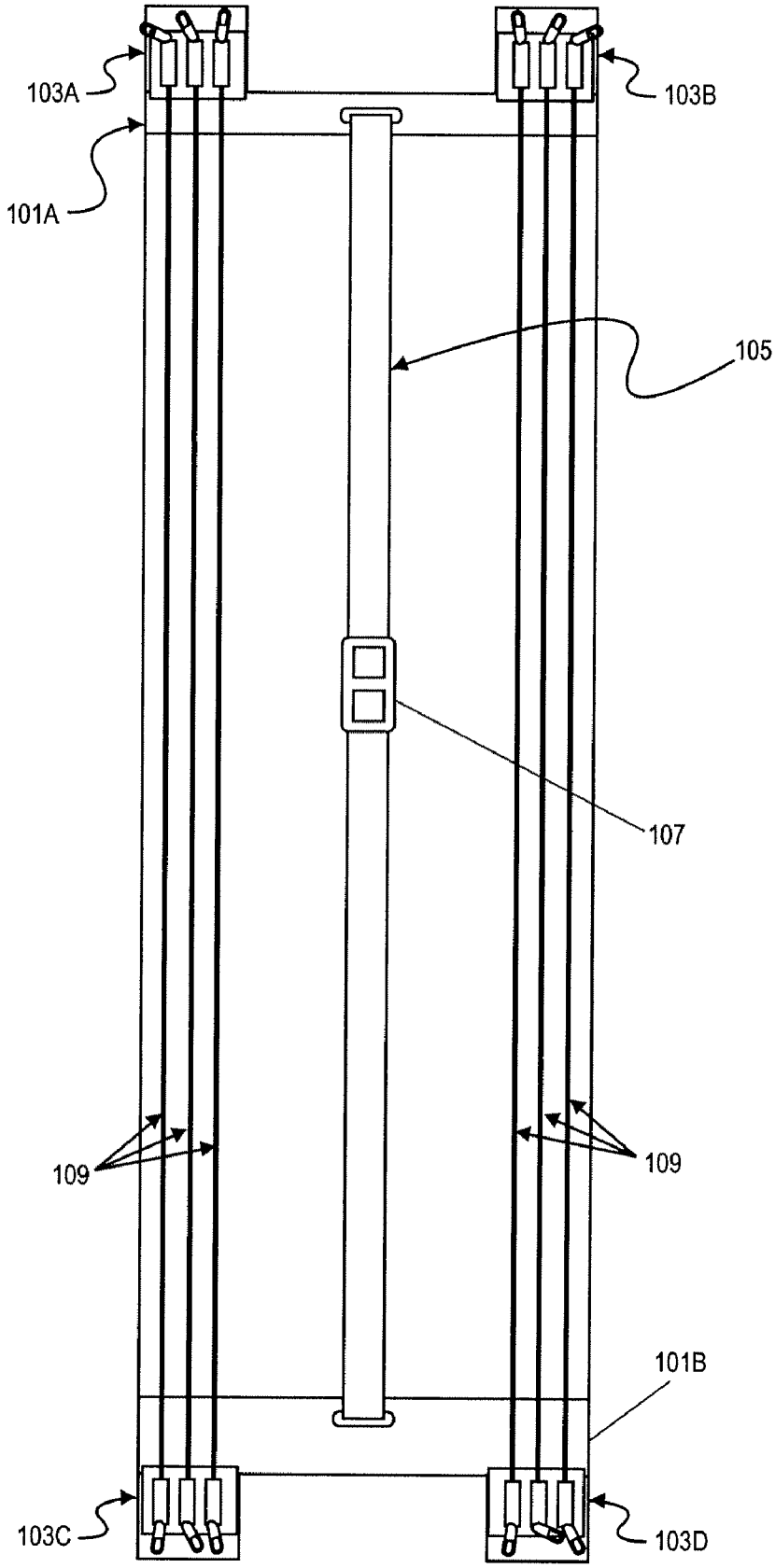
FIG. 1 is a diagram of one embodiment of a portable door mounted exercise system.

FIG. 1 is a diagram of one embodiment of a portable door-mounted exercise system. The portable door-mounted exercise system is designed to assist in aerobic, cardiovascular and muscle building exercises through the provision of resistance to the movements of a user. The system includes a set of elastic cords 109 that provide the resistance, a set of pulleys 103A-D to redirect forces acting on the elastic cords 109, a set of frames 101A, 101B, a locking strap 105, a set of brackets and a set of door mounts. A 'set,' as used herein refers to any positive whole number of items including one item.

The elastic cords 109 include a set of elastic strands that form a core of the cord. These elastic strands are covered in a flexible sheath. The flexible sheath can be made of nylon, cotton or other flexible materials. In another embodiment, the elastic cords are entirely composed of elastic strands or a monolithic elastic strand. Any elastic polymer, rubber or similar material can be utilized. The selection of elastic material as well as the size and shape of the elastic material can be based on the desired resistance in the elastic cord. Thicker, denser and less elastic materials will generally offer higher levels of resistance than thinner and more elastic materials.

The elastic cords 109 have a length approximating a standard door height when the elastic cords 109 are in a rest or non-stressed state. The elastic cords 109 can expand by several feet or even twice their length or more dependent on the force applied and the materials selected. In one example embodiment, the elastic cords are approximately six feet long at rest and can be stretched to approximately twelve feet in length. At each end of the elastic cords 109 a stop and latching mechanism are attached. These structures can be attached by clamping, adhesives, interlocking mechanisms or structures or similar attachment mechanisms or techniques. These features are described in further detail herein below in regard to FIG. 2.

Any number of elastic cords 109 can be utilize in the portable door-mounted exercise system. In one example embodiment, six elastic cords are included. Three cords are present on each side (left and right) of the system. One sub-set of the cords is arrayed to be used by the left hand or foot of the user and the other sub-set of the cords is arrayed to be used by the right hand or foot of the user. In the example embodiment, two of the cords offer the same level of resistance while the third cord in the set offers a higher level of resistance such as twice the resistance level of the other individual cords. This provides the user with a degree of flexibility in selecting the level of resistance when working out. For example, if two cords offer five pounds of resistance while the other cord offers ten pounds of resistance, then the user can select to use the cords individually or in combination to obtain a range of resistance from five pounds to twenty pounds for each set of elastic cords. If both ends of a set of elastic cords are utilized, then this range can be further increased.

In other embodiments, additional elastic cords can be included in each sub-set such that four, five or six elastic cords are present in each sub-set for a total of eight, ten or twelve elastic cords in the portable door-mounted exercise system. The resistance levels in each cord can be different or have a pattern to maximize the selections available to the user. Changes in resistance levels between the elastic cords can be proportionate or based on fixed ratios. For example, in an embodiment where three cords are present in each left/right set, two chords can have the same resistance (e.g. five pounds)

while the third has double the resistance level (e.g. ten pounds) of the other cords. In an example embodiment where five cords are present, there can be two cords with a first resistance level (e.g. five pounds), two cords with a second doubled resistance level (e.g., ten pounds) and a fifth cord with a quadrupled resistance level (e.g. twenty pounds). This distribution provides a user with a consistent level of granularity (i.e., five pound increments) for varying a selected resistance level for exercises.

The pulleys 103A-D are sets of mounted wheels that define grooves that complement the size of the elastic cords 109. The pulleys 103A-D are mounted to a set of brackets such that the individual pulleys have a range of lateral motion or are omnidirectional. The individual pulley wheels can be formed from any material capable of withstanding the compressing forces applied by the user and the elastic cords 109. The wheels can be formed from polymers, metals, alloys, natural materials and similar materials.

The pulleys 103A-D are positioned and mounted to a set of brackets and door mounting mechanisms that are described in greater detail herein below in regard to FIGS. 2-4. The sets of pulleys 103A-D are spaced apart from one another at respective top and bottom ends of the door by a set of frames 101A, 101B. These frames 101A, 101B provide horizontal stability to the system by rigidly connecting the respective door mounting mechanisms and brackets. The frames 101A, 101B also define interlocking components to receive a locking strap 105. The frames 101A, 101B can be formed from stainless steel, steel alloys, titanium alloys or similar lightweight, high strength materials. The frames 101A, 101B can have any shape with sufficient length to properly space the pulley sets 103A-D apart and define the interlocking mechanism for the locking strap 105. In one example embodiment, the frames 101A, 101B are generally rectangular, flat and have a length that is slightly less than the width (of the front surface) of a standard door. In one example embodiment, the frames 101A, 101B are seventeen inches long and seven inches wide.

The locking strap 105 can be a single strap or set of interlocking straps. The locking strap can be a nylon weave, cotton weave or other densely woven fabric. In other embodiments, other materials including elastic polymers, natural materials or similar materials can be utilized. The locking strap 105 allows the user to secure the upper and lower mounting mechanisms to the door by applying an inward tension to these structures through the frames 101A, 101B. The locking strap 105 can be redundant in this functional aspect with the elastic cords 109, which also act to secure the portable door-mounted exercise system to the door. However, during the set-up and take down of the system the locking strap 105 can hold the upper and lower mounting mechanisms in place while the user adds or removes the elastic cords 109, which are not centered and are difficult to manage during assembly and disassembly without the locking strap 105 to stabilize the system vertically.

The locking strap 105 can be attached to each frame 101A, 101B by looping through an aperture defined by each frame 101A, 101B. The loop can be closed by stitching, an attachment mechanism such as a catch, snap fit, buckle or similar mechanism. In one embodiment, the locking strap is attached to each frame separately with individual loops. In another embodiment, a single larger loop can be utilized or combinations thereof.

The individual locking strap 105 or a set of locking straps are then releasably coupled together with a release mechanism 107. The release mechanism 107 can be a clasp, buckle, snap-fit, or similar mechanism that allows for a quick separation of the locking strap 105 and the frames 101A, 101B to enable disassembly and dismounting of the system. The locking strap 105 can have any length appropriate for the size of the door and the overall portable door-mounted exercise system. For example, the system can have a height between 78 inches and 84 inches. In this case the locking strap 105 can have a length between 50 and 70 inches.

The portable door-mounted exercise system can have a depth between 1" and 3" dependent on the size of the door it is designed for. For example the depth can be 1⅝ inches. The overall weight of the system can be between six and ten pounds to allow it to be easily portable and capable of being carried in a small bag or case.

Figure 2:
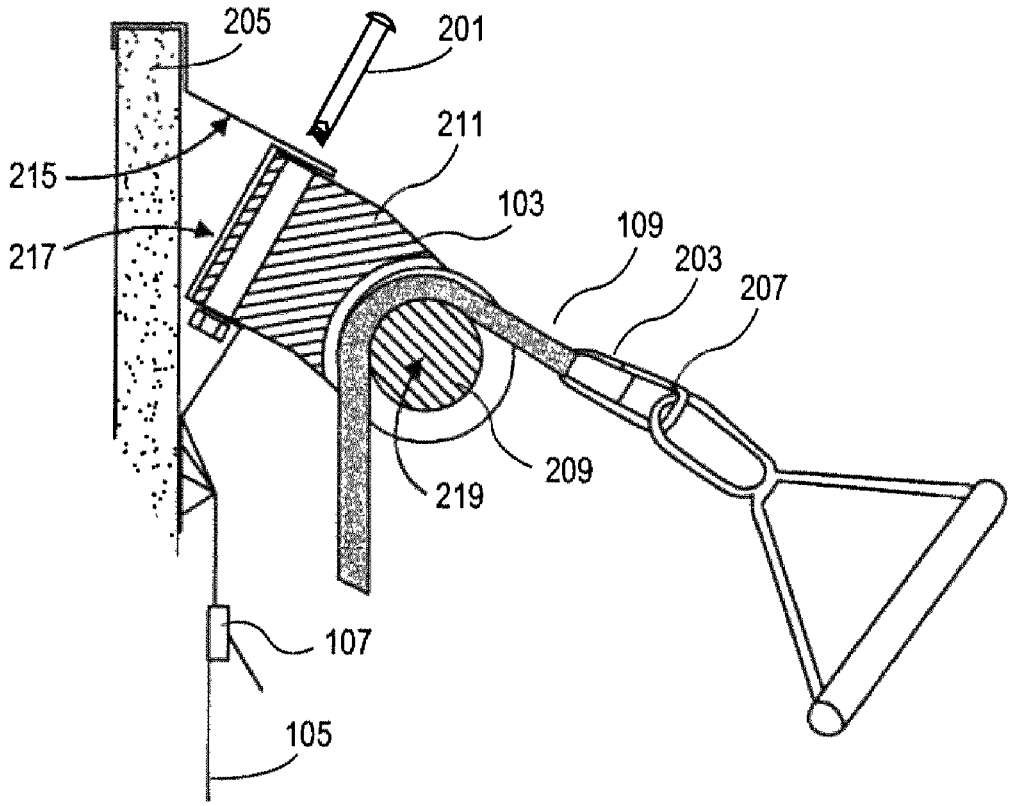
FIG. 2 is a diagram of one embodiment of a mounting and pulley system for the portable door mounted exercise system.

FIG. 2 is a diagram of one embodiment of a mounting and pulley system for the portable door mounted exercise system. The pulley systems 103 are mounted over a door 205 through a door mount 215 and bracket 217. The pulley systems 103 include a set of swivel bases 211, wheels 209 and axles 219. An example of a door top mount is described for sake of convenience and clarity. One of ordinary skill in the art would understand that the principles and structures described herein also are applicable to the door bottom mount structures, which are not separately described.

The door mount 215 over hangs or clamps the door 205 to rest the weight of the exercise system onto the door. The door mount 215 can be formed separately from or integrally with the bracket 217 and the frame 101. The door mount 215 can be formed from stainless steel, steel alloys, titanium alloys, and similar strong and lightweight materials. The door mount 215 has a thickness of approximately 1⅝ inches to provide clearance with the door frame. The overhang or clamp can have any length and has a width that matches the depth of the door. The door mount 215 can extend out from the door to provide a coupling point for the pulley system 103 and bracket 217 that is angled downward. In other embodiments, the bracket and pulley system 103 can be flush with or approximately flush with the surface of the door.

The bracket 217 can be attached to the door mount 215 and frame 101 through riveting, welding, bolts, or similar attachment mechanisms or techniques. The bracket 217 can also be integrally formed with the door mount 215 or the frame 101. The bracket 217 defines the attachment point for the pulley system 103 through a swivel point such as a bolt 201, pivot, fixed attachment or similar method of attachment using bolts, rivets, screws or similar attachment mechanisms. For example, in one embodiment, the bracket 217 defines openings to receive a bolt 201 that serves a swivel point for the pulley system 103 enabling a range of motion around the axis of the swivel point.

The base 211 of the pulley system 103 also defines a channel or similar structure to receive the swivel point or analogous mechanism. The base 211 provides a mounting point for the wheel 209 of the pulley system 103. The wheel 209 is attached to the base 211 through an axle 219. The axle 219 can allow a full 360 degrees of motion to the wheel 209 or can limit the rotation to less than full rotation in either direction or both directions.

The elastic cords 109 are disposed around the wheels 209 and between the base 211 and the wheel 209. The elastic cord 109 is terminated by a latch 207 and stop 203. The latch 207 provides a mechanism through which the elastic cord 109 can be attached to a handle, strap or similar interface for a user of the exercise system. The latch 207 can be any interlocking mechanism that allows any number of elastic cords 109 to be coupled to a handle, strap or similar device. In one embodiment, the handle is an ankle strap, squat strap, neck strap, wide grip bar, T-bar or similar gripping structure.

The stop 203 connects the latch 207 to the elastic cord 109 and prevents the elastic cord 109 from contracting through the pulley system 103. The stop 203 can include a clamp, latch, interlocking mechanism or similar mechanism for attachment to the elastic cord 109. The size and shape of the stop 203 prevent it from traversing the channel formed by the wheel 209 and the base 211 of the pulley system thereby remaining engaged with the pulley system 103. The pulley wheel 209 can be either removably coupled to the base 211 or have spring loaded or similarly biased attachment that allows the wheel 209 to be moved away from the base to allow the elastic cord 109 to be disengaged for purposes of disassembly.

The strap 105 can be attached to the frame 101 by looping through an aperture defined by the frame 101. The frame 101 can also define protruding structures, such as a triangle or pyramid shaped protrusion 225, to position the strap 105 and lock 107 away from the surface of the door 205. The protrusion 225 and positioning of the strap 105 and lock 107 away from the door provides a balance or countervailing force during use of the door gym when the user is pulling on the elastic chords to provide a stable mount to the door. In an alternative embodiment, the strap 105 and lock 107 are flush with the surface of the door 205 to secure the exercise machine to the door 205 and ensure the pulley system 103 and elastic cords 109 are stably connected to door 205.

Figure 3A:
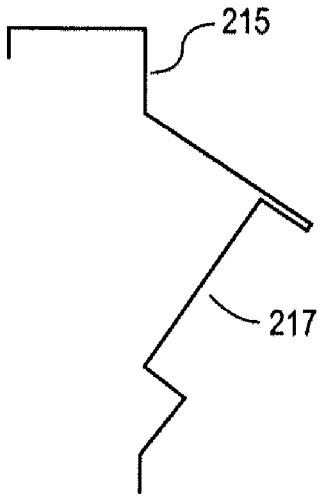
FIGS. 3A and 3B are diagrams of one embodiment of a door mount and bracket for the portable door mounted exercise system.
Figure 3B:
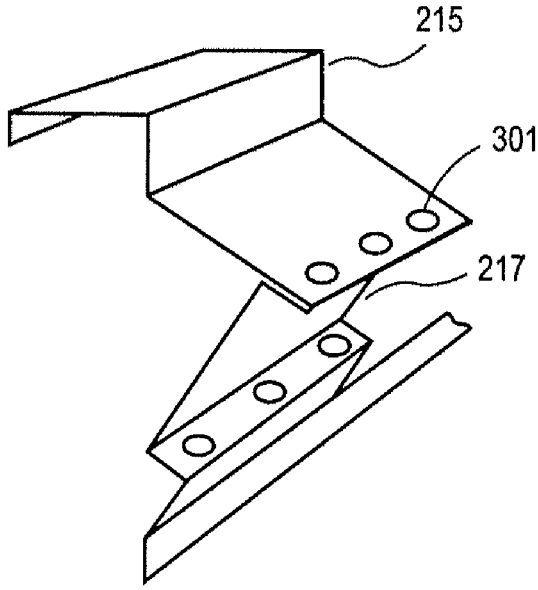

FIGS. 3A and 3B are diagrams of one embodiment of a door mount and bracket for the portable door mounted exercise system. In this example embodiment, the door mount 215 or clamp structure is integrally formed with the bracket structure 217 and defines an angle at which the pulley system is to be mounted. The holes 301 for receiving the swivel or pivot points are defined by the integral structure.

Figure 4:
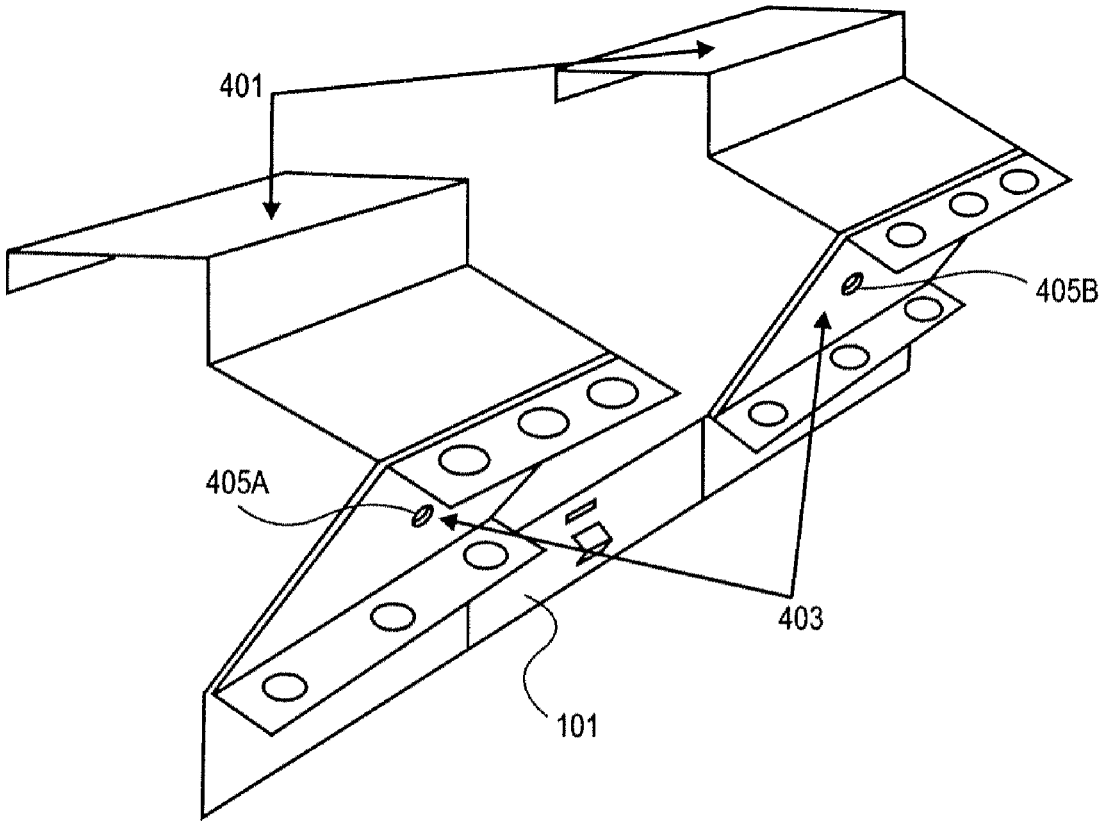
FIG. 4 is a diagram of another embodiment of a door mount and bracket for the portable door mounted exercise system.

FIG. 4 is a diagram of another embodiment of a door mount and bracket for the portable door-mounted exercise system. In this example embodiment, the door mounts 401 are directly coupled to the frame 101 and separate from the brackets 403. The door mounts 401 define the angle at which the brackets 403 are attached to the exercise system. The brackets 403 are attached to the door mounts 401 by a set of bolts 405A, 405B, rivets, screws or similar attachment mechanisms.

Figure 5:
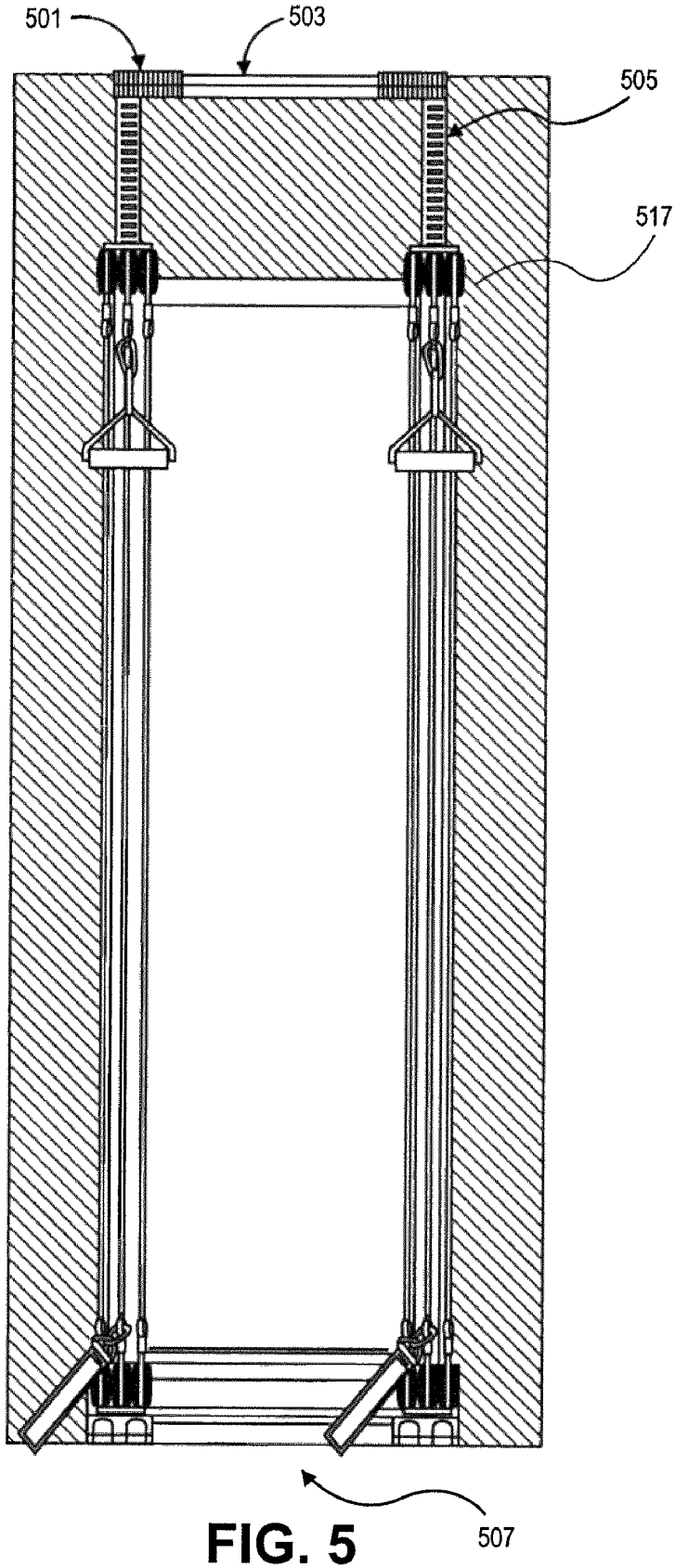
FIG. 5 is a diagram of a one embodiment of an adjustable door mount for the portable door mounted exercise system.

FIG. 5 is a diagram of a one embodiment of an adjustable door mount for the portable door mounted exercise system. The adjustable door mount includes a set of overhang structures 501, a top cross-bar 503, a set of rails 505 and an adjustable bracket 517. The bottom mount 507 is fixed and also includes a set of overhang structures and a cross-bar and is described in further detail in regard to FIG. 9. The other components of the door gym including the elastic cords, pulleys and similar components can be similar or identical to those used in the other embodiments described herein above. The adjustable door mount system allows the height of the top sets of pulleys to be adjusted as desired by the user and allows the door mounted gym system to provide a consistent experience independent of the size (e.g., height) of the door upon which it is mounted. The adjustment also provides greater flexibility for positioning relative to the height of the user to allow the user to focus exercise on specific muscles or ranges of movement.

Figure 6:
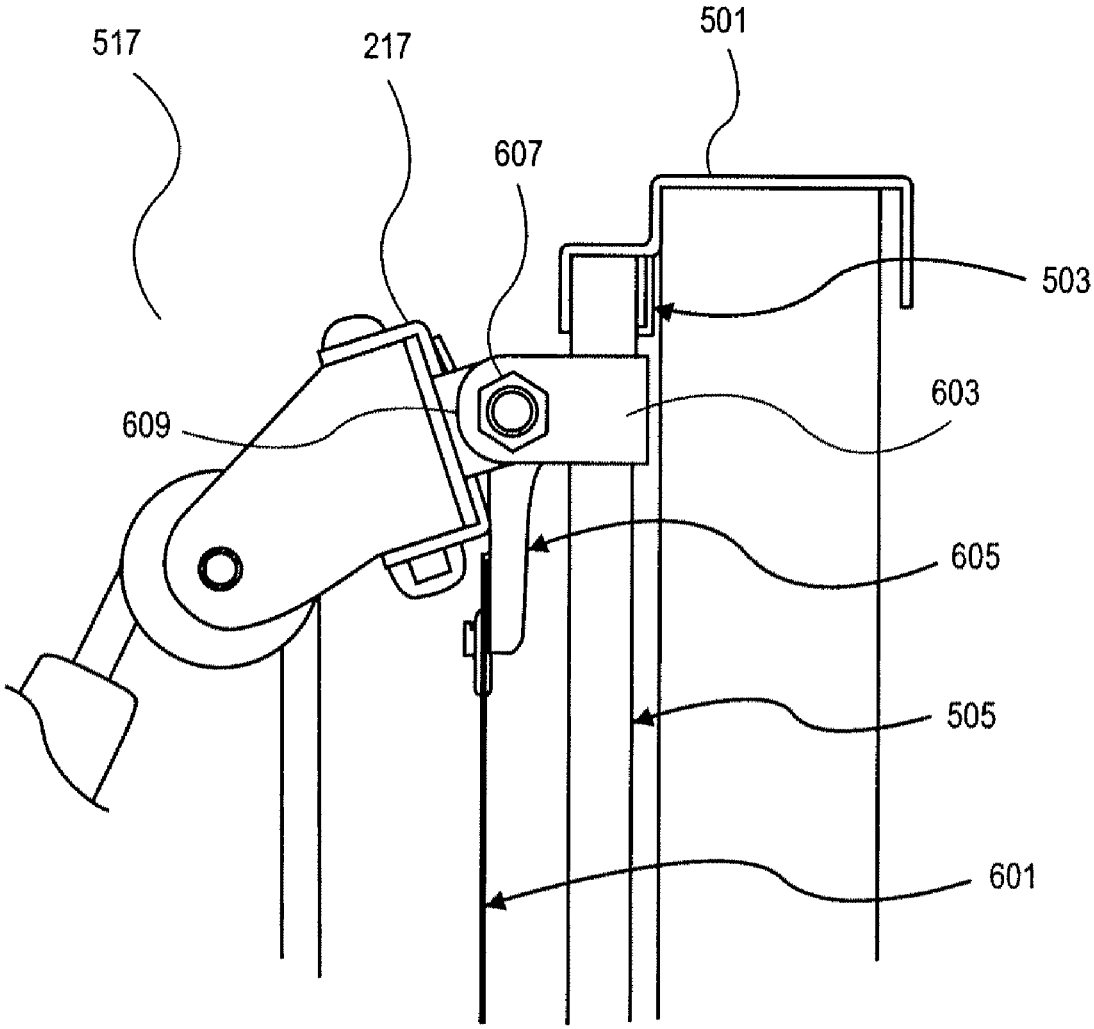
FIG. 6 is a diagram of one embodiment of the adjustable bracket.

FIG. 6 is a diagram of one embodiment of the adjustable bracket. The adjustable bracket 517 includes a bracket 217, a bracket mount 609, a pivot mechanism 607, a brace 603 and an engagement mechanism 605. The adjustable bracket 517 is mounted onto a rail 505 that is attached to the cross-bar 503 and overhang structures 501. The components of the adjustable bracket 517 can be formed from any high strength materials, including stainless steel, iron, aluminum, alloys, plastics and similar materials.

The adjustable bracket 517 rotates from an open or unlocked position to a closed or locked position relative to the rail 505. The adjustable bracket 517 can slide relative to the rail 505 when in the open position to enable the user to adjust the height of the pulley system attached to the adjustable bracket 517 relative to the top or bottom of the door. The engagement mechanism 605 secures the adjustable bracket 517 to the rail 505 when the adjustable bracket 517 is in a closed position. The engagement mechanism 605 can include a biasing force to exert a clamping pressure on the rail 505 in conjunction with the brace 603. In another embodiment, the engagement mechanism 605 can also be secured to the rail 505 through an interlocking mechanism, latching mechanism or similar mechanism to secure the relative positions of the rail and the bracket 517.

The engagement mechanism 605 can also secure the adjustable bracket 517 and upper mounting mechanism to the bottom mounting mechanism through a strap 601 that connects the upper and bottom mounts. The strap 601 can be an elastic cord or an adjustable length strap ties the adjustable bracket 517 to the other mount. The strap 601 can also provide a biasing force on the engagement mechanism 605 to secure it to the rail 505. In another embodiment, the strap 601 is replaced by a backing constructed of a flexible material to form a flat surface upon which printed material can be placed including exercise related information and information on the use of the door mounted gym. The backing can be coupled to the engagement mechanism through a hook and loop or ring or similar mechanism. The backing is also attached to the bottom mount to secure it at each corner roughly parallel to the door.

The adjustable bracket 517 rotates between the open and closed positions through a pivot mechanism 607. The pivot mechanism 607 can also join the brace 603 and the bracket mount 609. Any type of rotating or pivoting mechanism 607 can be utilized including a blot that provides between a ten degree and 180 degree range of movement.

Figure 7:
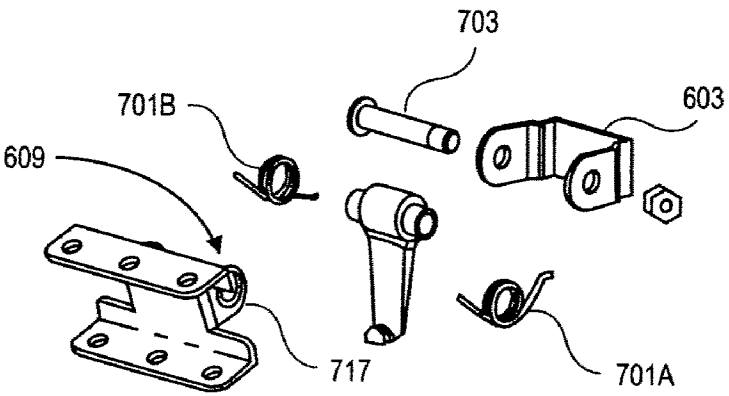
FIG. 7 is a diagram of one embodiment of the parts of the adjustable bracket.

FIG. 7 is a diagram of one embodiment of the parts of the adjustable bracket. This view provides an illustration of the individual parts of the adjustable bracket 517. The bracket 217 can be of any size and designed to accommodate a set of pulleys having a vertical orientation. The bracket 217 can be removably coupled to or intrinsically formed with a bracket mount 609. The bracket mount 609 can be welded, bolted, interlocking or similarly coupled to the bracket 217. Similarly the bracket mount 609 can define a set of apertures for receiving the bolt 703 or similar pivot mechanism that couples the mounting bracket 609 with the engagement mechanism and brace 603.

The engagement mechanism can also be coupled to the bracket mount 609 and brace 603 with a set of torsion springs 701A,B that provide a biasing force to bias the engagement mechanism toward a closed position. The torsion springs 701A,B can work in conjunction with the elastic cords and straps to provide the biasing force that secures the adjustable bracket to the rails.

A bolt 703 or similar pivoting mechanism can be secured to the brace 603, engagement mechanism and mounting bracket 609 through a set of apertures in each component and a locking nut or similar securing mechanism.

Figure 8:
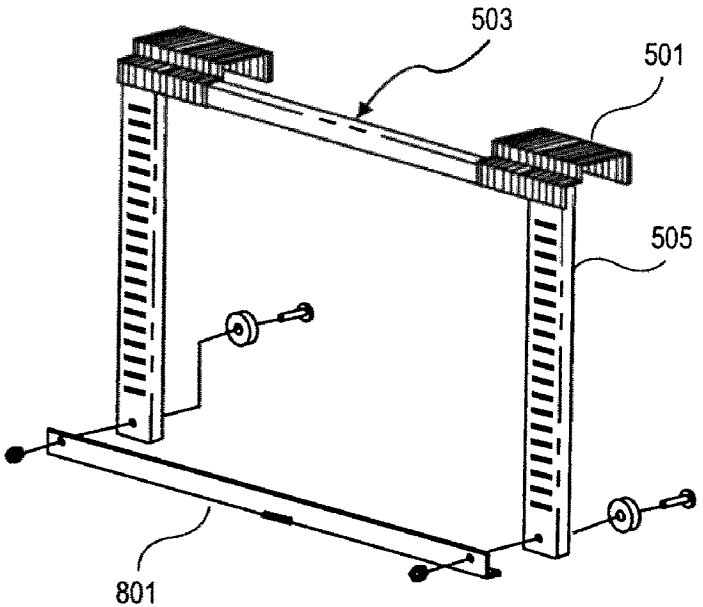
FIG. 8 is a diagram of one embodiment of the parts of the top door mount.

FIG. 8 is a diagram of one embodiment of the parts of the top door mount. The top door mount includes a set of overhang structures 501, a top cross-bar 503 and a bottom cross-bar 801. The overhang structures 501 have a shape that matches the top of a cross-section of a door to wrap around the top of the door and distribute the load or weight of the door gym to the top of the door and the door frame when the door is closed. The overhang structures 501 can run the length of the top of the door and the cross-bar 503 or any length thereof. A symmetrical placement of the overhang structures on the cross-bar distributes the load more evenly and provides the most stable structure.

The cross-bar 503 joins the overhang structures 501 to the rails 505. The cross-bar 503 can be welded, bolted, integrally formed or similarly coupled to the rails 505 and overhang structures 501. Similarly, the bottom cross-bar 801 joins the two bottom ends of the rails 505 to provide greater stability to the top door mount structure and a stop for the adjustable brackets. The bottom cross-bar 801 can be welded, bolted, integrally formed or similarly coupled to the rails 505. The bottom cross-bar 801 can also define an opening to receive a set of straps or similar structures that connect the bottom-cross bar 801 to the bottom mount.

Figure 9:
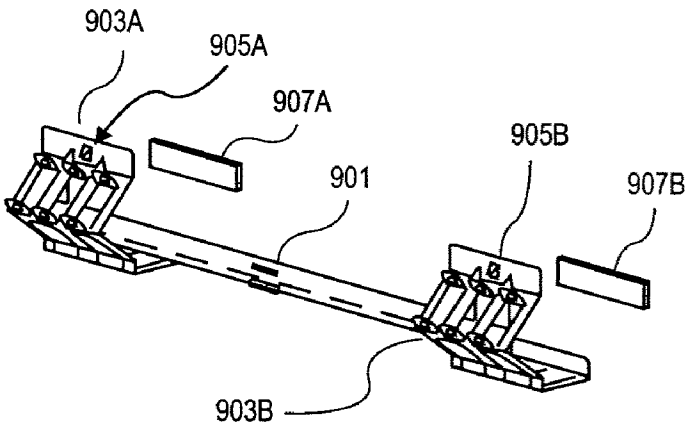
FIG. 9 is a diagram of one embodiment of the parts of the bottom door mount.

FIG. 9 is a diagram of one embodiment of the parts of the bottom door mount. The bottom door mount includes a set of bracket mounts 903A,B, a cross-bar 901 and pads 907A,B. The bracket mounts 903A,B define a structure on which the set of pulleys can be mounted. Each bracket mount 903A,B can define a strap or backing attachment mechanism 905A,B. The strap or backing attachment mechanism 905A,B can be hooks, openings, latches or similar mechanisms for attaching a strap or backing to the bottom door mount.

The cross-bar 901 can similarly define a set of attachment mechanisms for receiving straps or a backing that couples the bottom door mount to the top door mount. The cross-bar 901 can also define or be coupled to an overhang structure that wraps around the bottom of a door. The cross-bar 901 can have an 'L'-shape or similar shape that in conjunction with the bracket mounts 903A,B defines a 'U'-shape that when coupled to the top door mount secures the door gym to a door.

Figure 10:
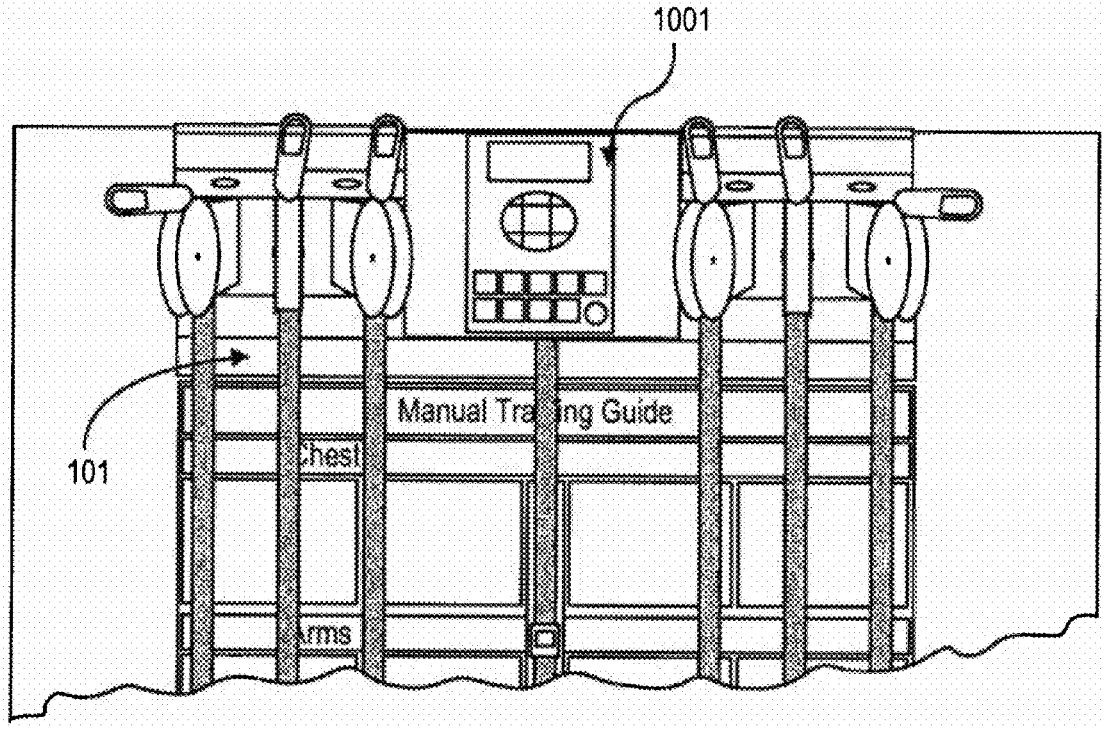
FIG. 10 is a diagram of one embodiment of the portable door mounted exercise system with a training computer.

FIG. 10 is a diagram of one embodiment of the portable door-mounted exercise system with a training computer. The exercise system can include a training computer 1001. The training computer 1001 can be mounted at the top or bottom of the machine. The training computer 1001 can be mounted to the frame 101, door mounts, brackets or similar structures of the exercise system. The training computer 1001 can include audio/visual components such as speakers and displays (e.g., liquid crystal displays) to provide instruction or motivation to a user. The training computer 1001 can collect user data such as completed exercise information, heart rate and similar information. The training computer 1001 can also monitor the status and use of the exercise system such as the types of exercise performed, the resistance levels used, timer information and similar information. The training computer 1001 can provide guided work out information, feedback, motivational information or similar information.

The training computer 1001 can also have alternative or additional features including music playback (e.g., compact discs, MP3 or similar music sources), video playback, satellite and broadcast television programming, digital versatile disc (DVD) playback, computer connectivity, video games, and similar features can also be included with the training computer. The training computer can be battery operated or connected to external power.

In the foregoing specification the invention has been described with reference to specific embodiments thereof. It will however be evident that various modifications and changes can be made thereto without departing from the broader spirit and scope of the invention as set forth in the appended claims. The specification and drawings are accordingly to be regarded as an illustrative rather than in a restrictive sense.

What is claimed is:

1. An apparatus comprising:

a first door mounting mechanism to couple the apparatus to a top of a door;

a first bracket coupled to the first door mounting mechanism;

a first plurality of pulleys coupled to the first bracket;

a first plurality of elastic cords each coupled to respective pulleys in the first plurality of pulleys, the first plurality of elastic cords including a first elastic cord having a first resistance and a second elastic cord having a second resistance level;

a first handle removably coupled to any combination of the first plurality of elastic cords;

a second door mounting mechanism to couple the apparatus to the top of the door;

a second bracket coupled the second door mounting mechanism;

a second plurality of pulleys coupled to the second bracket;

a second plurality of elastic cords each coupled to respective pulleys in the second plurality of pulleys, the second plurality of elastic cords including a third elastic cord having a first resistance and a fourth elastic cord having a second resistance;

a second handle removably coupled to any combination of the second plurality of elastic cords;

a frame coupled to the first bracket and the second bracket; and a locking strap to couple the frame to a third door mounting mechanism, the third door mounting mechanism to couple the apparatus to a bottom of the door.

2. The apparatus of claim 1, wherein the first plurality of elastic cords include a fifth elastic cord having a first resistance.

3. The apparatus of claim 1, wherein the second resistance is twice the first resistance.

4. The apparatus of claim 1, further comprising:

a training computer to execute a training program, the training computer coupled to the frame.

5. The apparatus of claim 1, wherein each of the first plurality of elastic cords includes a latching mechanism at each end to couple to a handle.

6. The apparatus of claim 1, wherein the tension in the first plurality of elastic cords and the second plurality of elastic cords secures the apparatus to the door.

7. The apparatus of claim 1, wherein the locking strap comprises:

a nylon strap;

a first frame locking mechanism;

a second frame locking mechanism; and a release mechanism.

8. The apparatus of claim 1, wherein the first bracket is adjustably coupled to the first door mounting mechanism.

9. The apparatus of claim 8, wherein the first door mounting mechanism includes a rail and the first bracket includes an engagement mechanism to secure the first bracket to the rail .

* * * * *